US005743058A

United States Patent [19]

Boomsma

[11] Patent Number: 5,743,058

[45] Date of Patent: Apr. 28, 1998

[54] BOARD WALL SYSTEM

[75] Inventor: Harmen Boomsma, Den Haag, Netherlands

[73] Assignee: Flex Development B.V., Delft, Netherlands

[21] Appl. No.: 379,565

[22] PCT Filed: Mar. 11, 1993

[86] PCT No.: PCT/NL93/00057

§ 371 Date: Apr. 10, 1995

§ 102(e) Date: Apr. 10, 1995

[87] PCT Pub. No.: WO94/04770

PCT Pub. Date: Mar. 3, 1994

[30] Foreign Application Priority Data

| | | | |
|---|---|---|---|
| Aug. 14, 1992 | [NL] | Netherlands | 9201455 |
| Nov. 23, 1992 | [NL] | Netherlands | 9202034 |
| Jan. 25, 1993 | [NL] | Netherlands | 9300141 |

[51] Int. Cl.[6] ..... E04B 2/78

[52] U.S. Cl. ..... 52/481.2; 52/482; 52/483.1; 52/763

[58] Field of Search ..... 52/481.2, 481.1, 52/482, 483.1, 479, 763, 281, 588.1, 586.1, 592.1

[56] References Cited

U.S. PATENT DOCUMENTS

| | | | |
|---|---|---|---|
| 356,238 | 1/1887 | Balsar | 52/592.1 |
| 2,004,193 | 6/1935 | Cherry | 52/592.1 X |
| 2,851,740 | 9/1958 | Baker | 52/479 |
| 2,958,982 | 11/1960 | Baker | 52/481.2 X |
| 3,533,205 | 10/1970 | Pestel et al. | 52/481.1 X |
| 3,862,530 | 1/1975 | Martine | 52/481.1 X |
| 4,170,859 | 10/1979 | Counihan | 52/586.1 X |
| 4,443,991 | 4/1984 | Mieyal | 52/481.2 X |
| 4,464,875 | 8/1984 | Wendt et al. | 52/489.1 |
| 4,628,656 | 12/1986 | Meuchetti et al. | 52/481.2 |
| 4,833,849 | 5/1989 | Williams et al. | 52/481.1 X |
| 5,094,052 | 3/1992 | Gudmundsson | 52/763 X |

FOREIGN PATENT DOCUMENTS

| | | |
|---|---|---|
| 22520-77 | 8/1978 | Australia . |
| 2107822 | 11/1972 | Germany . |
| 2231771 | 1/1974 | Germany . |

*Primary Examiner*—Robert Canfield
*Attorney, Agent, or Firm*—Banner & Witcoff, Ltd.

[57] ABSTRACT

The invention relates to a wall board suitable for fixing to two profiles (1) extending vertically along the edges of the wall board (5), wherein the wall board is adapted for gripping by the profiles in form-fitting manner. As a result of this step no use need be made of fixing means which grip directly onto the wall board itself, so that damage of the wall board itself is avoided, and the boards with the profiles are completely re-usable. It is even possible to arrange finishes on the boards before assembly. According to a preferred embodiment the gripping means are formed on at least a first edge of the wall board (5) by noses (12) arranged on the profile, wherein a groove for the profile extends partially between the nose and the wall board.

6 Claims, 7 Drawing Sheets

BOARD WALL SYSTEM

The invention relates to a wall board suitable for fixing to two profiles extending vertically along the edges of the wall board.

Such wall boards are known from the Netherlands patent application 88.03078.

With this known wall board use must be made of clamps to fix it to profiles.

The object of the invention is to provide a wall board wherein no use need be made of clamps, wherein the wall boards can be fixed to the profiles such that after possible demolition of the wall at least the wall boards can be reused, and which can be constructed more quickly, which is detachable, and wherein all surface finishes are possible.

This object is achieved in that the wall board is adapted for gripping by the profiles in form-fitting manner.

As a result of this step no use need be made of fixing means which grip directly onto the wall board itself, so that damage of the wall board itself is avoided, and the boards with the profiles are completely re-usable. It is even possible to arrange finishes on the boards before assembly.

According to a preferred embodiment the gripping means are formed on at least a first edge of the wall board by noses arranged on the profile, wherein a groove for the profile extends partially between the nose and the wall board.

The invention will now be elucidated with reference to the annexed drawings, in which.

Figure 10:
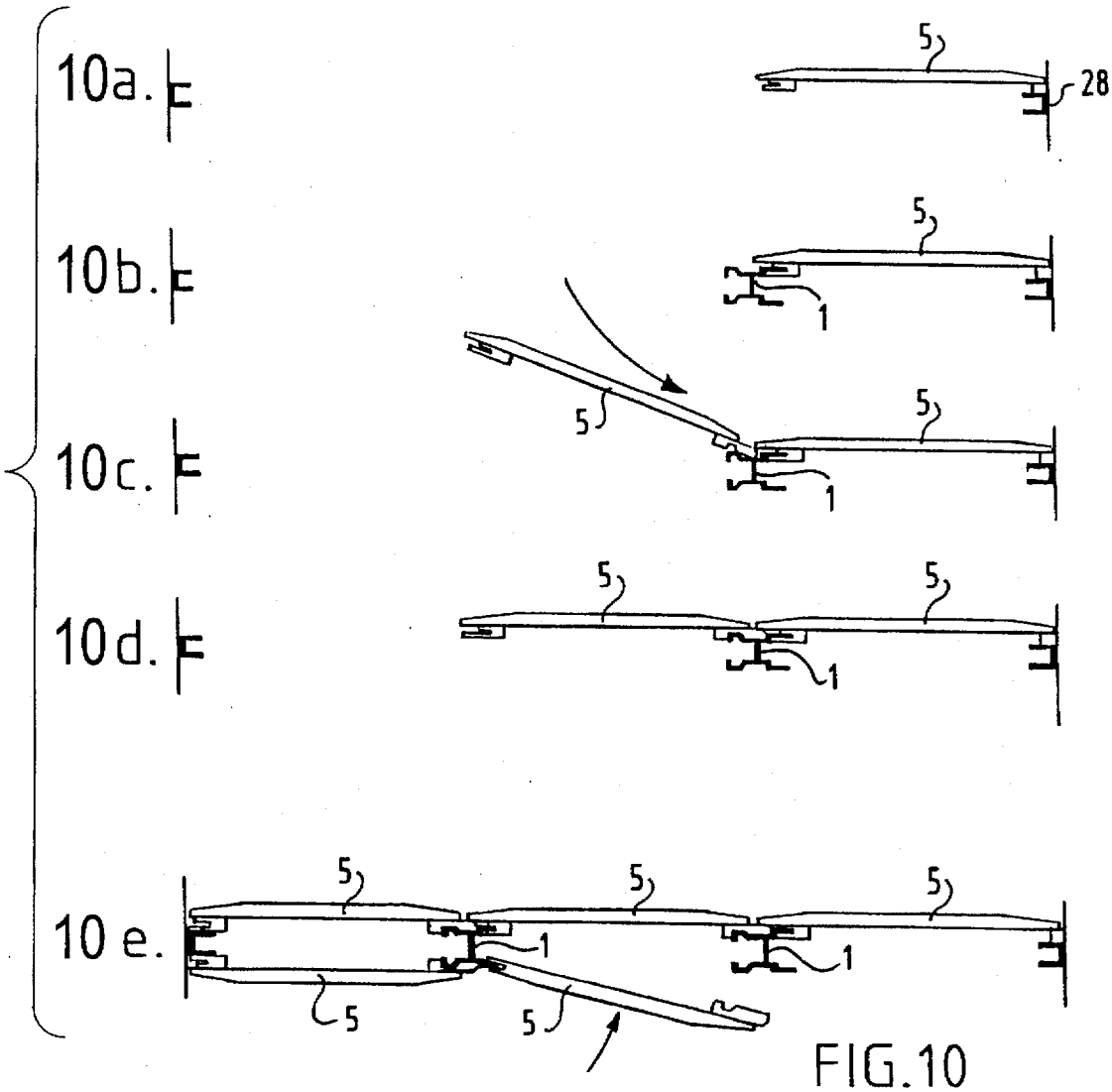
Figure 11:
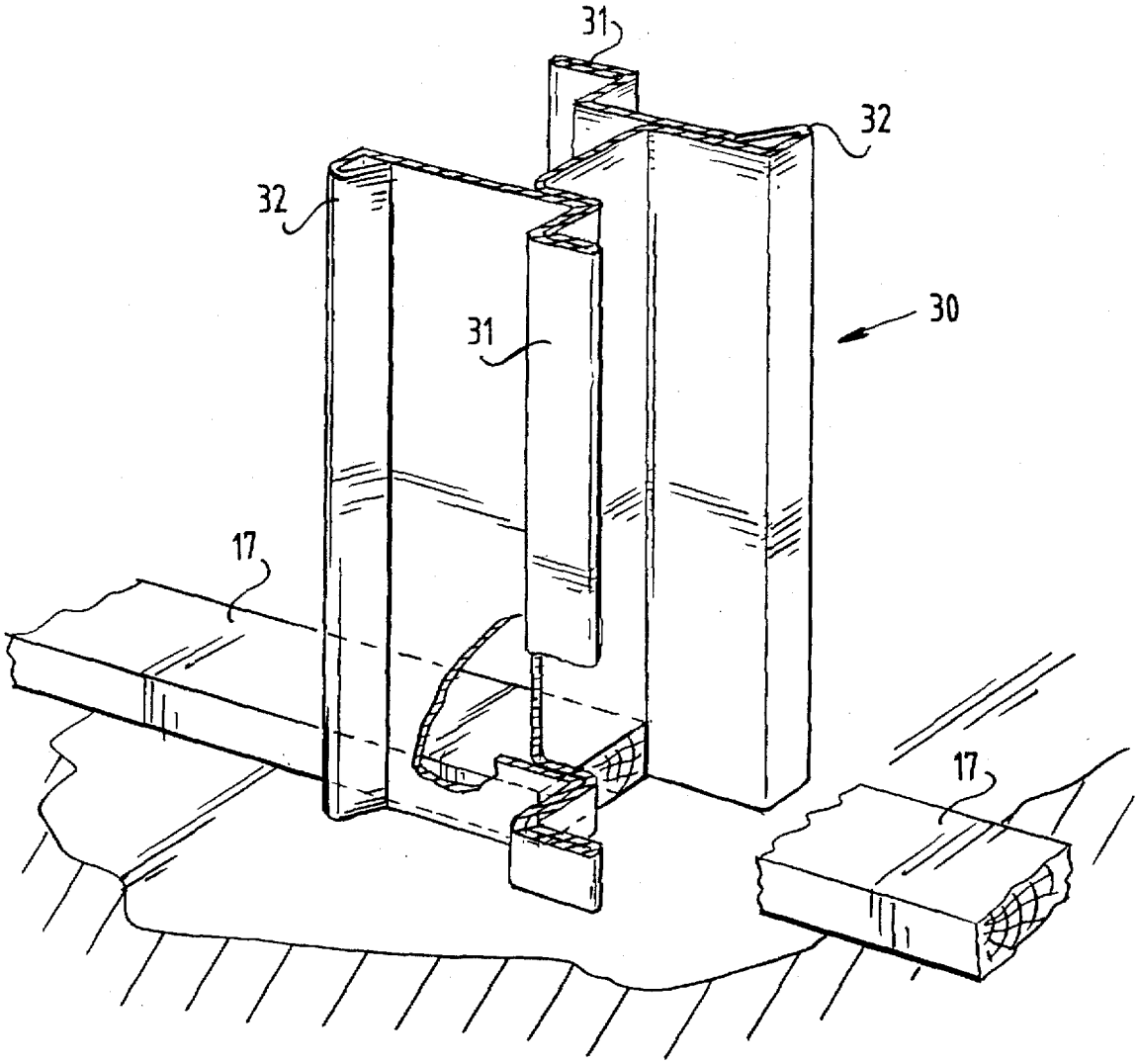

FIGS. 10*a–e* show sectional views of the process of single-sided constructing of a wall with wall boards according to the invention;

FIGS. 11 shows a partially broken away perspective view of an alternative embodiment of a profile for use in the invention; and FIG. 12*a–g* show views corresponding to FIG. 10 with use of the profile depicted in FIG. 11.

Figure 1:
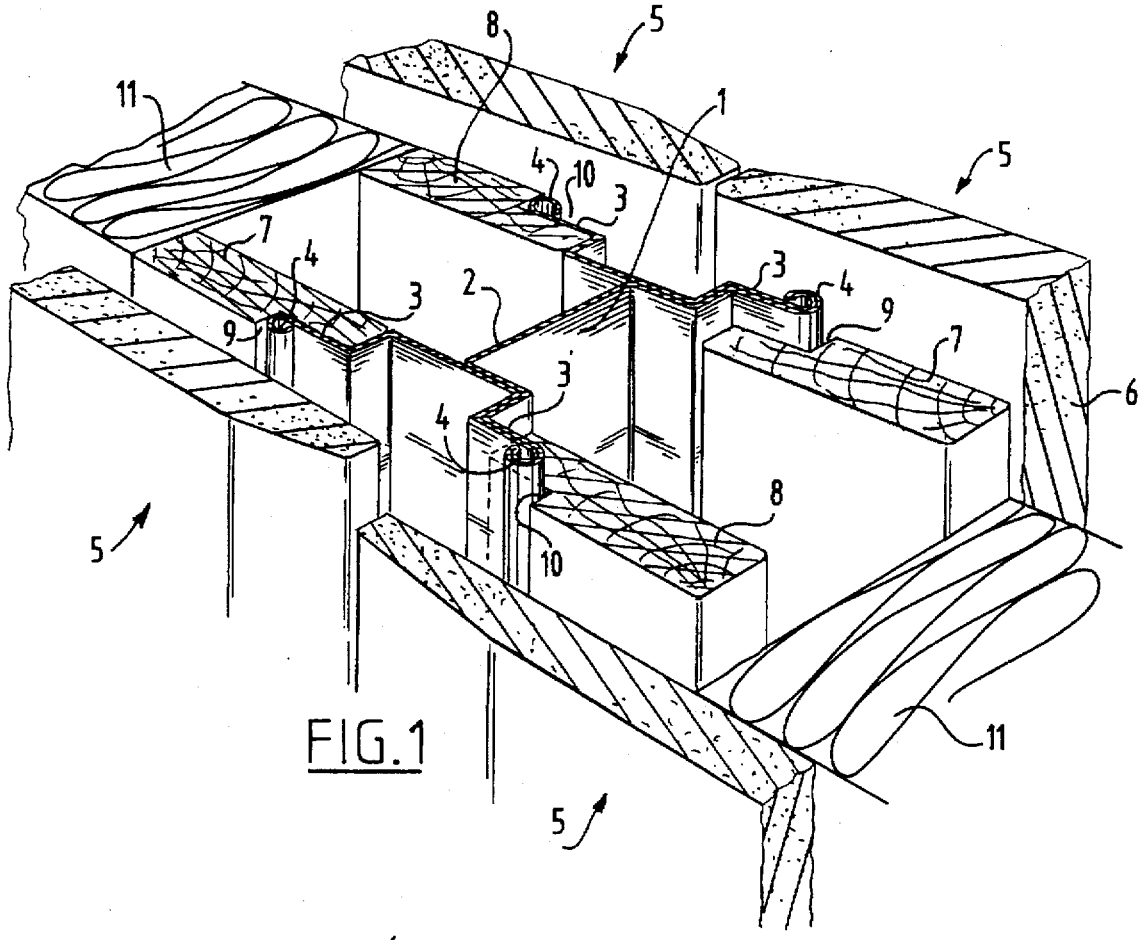
FIG. 1 shows a partially broken away perspective view of the first embodiment of the invention.

In FIG. 1 a profile 1 is shown with a substantially H-shaped structure. The profile is formed from a rolled steel plate which is deformed such that the structure shown in FIG. 1 results. This structure comprises a connecting piece 2, to which four legs 3 are fixed which are each provided at their end with a beaded edge 4. It is of course also possible to use a differently manufactured profile, for example an extruded aluminium profile.

The profile extends in vertical direction, and the fixing thereof will be described in further detail below with reference to FIG. 5.

With reference to FIG. 1, fixed against the profile are wall boards 5 which are each formed by for instance a plasterboard 6 against the inner side of which are fixed two frame strips 7 and 8 respectively made of foam plastic. It is possible to use other materials instead of foam plastic, for example non-foamed plastics, timber or plaster.

Both frame strips 7, 8 attached to one board 6 extend in the vicinity of a side edge of the board 6. In this embodiment they do not extend beyond the relevant side edge. Arranged in each of the frame strips 7, 8 is a recess 9 and 10 respectively into which one of the legs 3 of the profile 1 can be pushed and wherein the legs 3 thus provide good fixation through the enclosing thereof between the frame strip 7, 8 respectively and the board 6.

The construction proceeds as follows. By placing a first profile 1 the wall boards 5 can be pushed on either side thereof, after which the following profile can be placed and the legs 3 fastened to the relevant profile enclose the wall boards 5, 6, and the process can be continued. It is possible, although not necessary, to fill the space between the wall boards 5 with sound-damping and/or insulating material, for example mineral wool 11.

Figure 2:
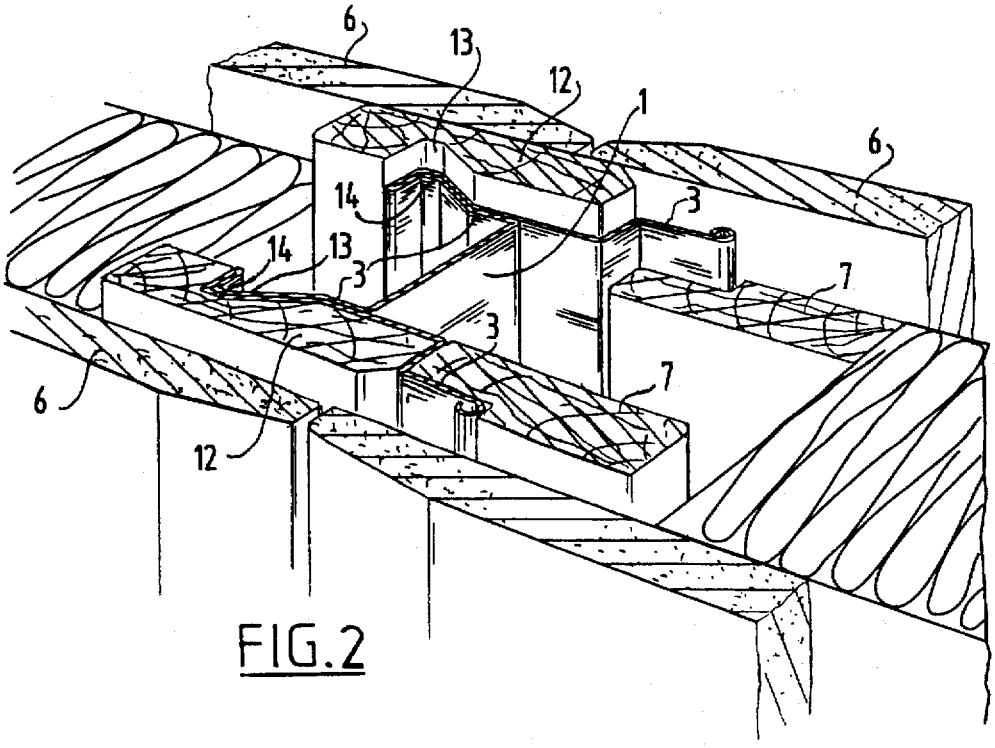
FIG. 2 is a partially broken away perspective view of a second embodiment of the invention.

The embodiment shown in FIG. 2 differs from the embodiment illustrated in FIG. 1 in the fact that one of the two frame strips attached to a board is replaced by frame strips 12 with a different configuration. The frame strip 12 is fixed directly to the plasterboard 6 and extends slightly beyond the edge of the plasterboard 6. A recess 13 is further arranged on the side of the frame strip 12 facing away from the plasterboard 6.

The profile 1 is modified accordingly. Two of the legs 3 of profile 1 are provided with a deformation 14 that forms a ridal which fits into the shoulder or recess 13 in the relevant frame strip. In this embodiment fixation by means of the frame strips 7 takes place in the same way as in the embodiment shown in FIG. 1; fixation in the case of frame strips 12 takes place in that the frame strip 12 extends beyond the edge of plasterboard 6, and is enclosed between the edge of the connecting plasterboard 6 and the relevant legs 3 of profile 1. Fixation in lengthwise direction takes place by the recess 13 and the deformation 14 of the relevant leg 3 engaging therein. Another advantage of the embodiment shown in FIG. 2 is that the noses protrude outside the board so that damage to the edge is prevented as far as possible.

Figure 3:
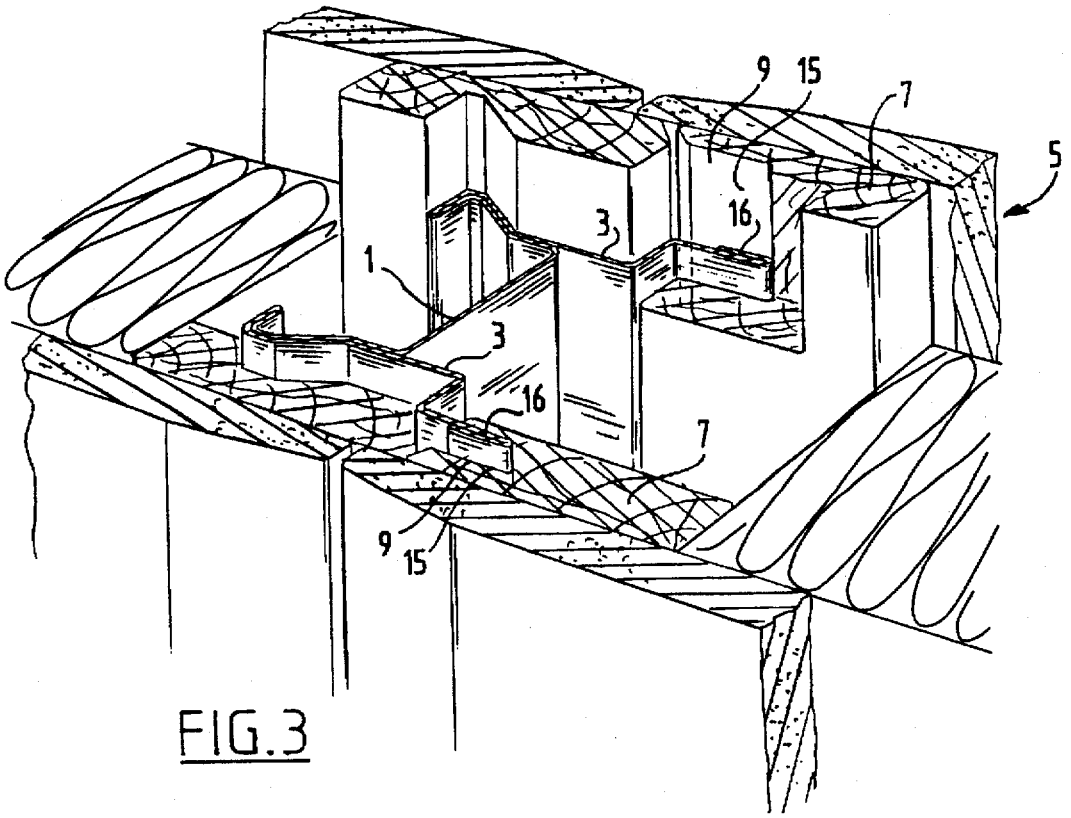
FIG. 3 is a perspective view of a third embodiment of the invention.

The embodiment shown in FIG. 3 corresponds generally with the embodiment depicted in FIG. 2, with the understanding that differently formed recesses 9 are arranged in the frame strips 7. The recesses 9 arranged in this latter embodiment are formed by grooves 15 arranged in the frame strip 7 and extending parallel to the wall, into which grooves can be placed a spring 16 arranged on the relevant leg 3 of the profile 1. Locking thus takes place, resulting in fixation of the wall board 5 relative to the profile 1.

It also the case in these embodiments shown in FIG. 2 and 3 that the frame strips 7, 8 do not necessarily have to be made of timber, but can also be manufactured from foamed plastic.

Figure 4:
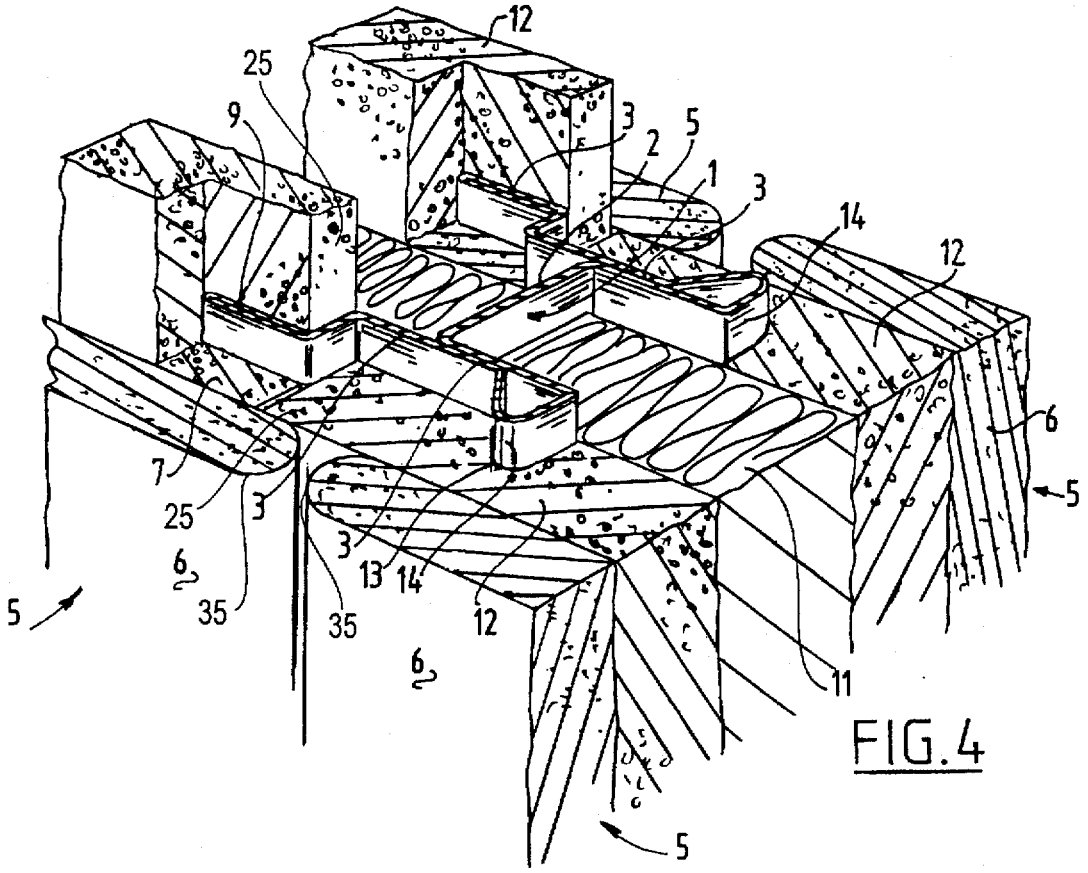
FIG. 4 is a partially broken away perspective view of a fourth embodiment of the invention.

Such an embodiment, the frame strips of which are made of foamed plastic, is shown in FIG. 4. The foamed plastic extends herein over the entire internal surface of the wall board, instead of having specifically formed frame strips having a definite width that may be less than the width of the wall board as shown in FIG. 3. This embodiment thus has the advantage that a better thermal insulation is obtained than in the other embodiments. It is of course possible to cover only a portion of the internal surface of the board with foam, for example by arranging a foam strip only in the middle, when the board rests against a profile to be additionally arranged. As shown in FIG. 4, the remaining space can likewise be filled with a mineral wool.

An advantage of the layer extending over the entire surface is that additional supporting profiles can be arranged, for example in the middle of the board, so that the wall can withstand greater forces. This is also an advantage in a situation wherein openings for windows and doors have to be arranged in a wall so that fixing of the board has to take place at a distance from the original edge of the board. These additional supporting profiles can be formed by standard profiles normally used in the construction industry. The dimensioning of the profiles associated with the invention is adapted thereto. As shown in FIG. 4, profile 1 includes a ridge or deformation 14 that cooperates with shoulder or recess 13 to avoid movement of the wall board in the horizontal direction. Each wall board 5 also includes a nose 25 and an edge 35. As illustrated, the wall boards 5 are arranged with profile 1 such that the nose 25 of a first wall board 5 is fit for locking between the profile 1 and the inner surface of edge 35 of another wall board 5.

Figure 5:
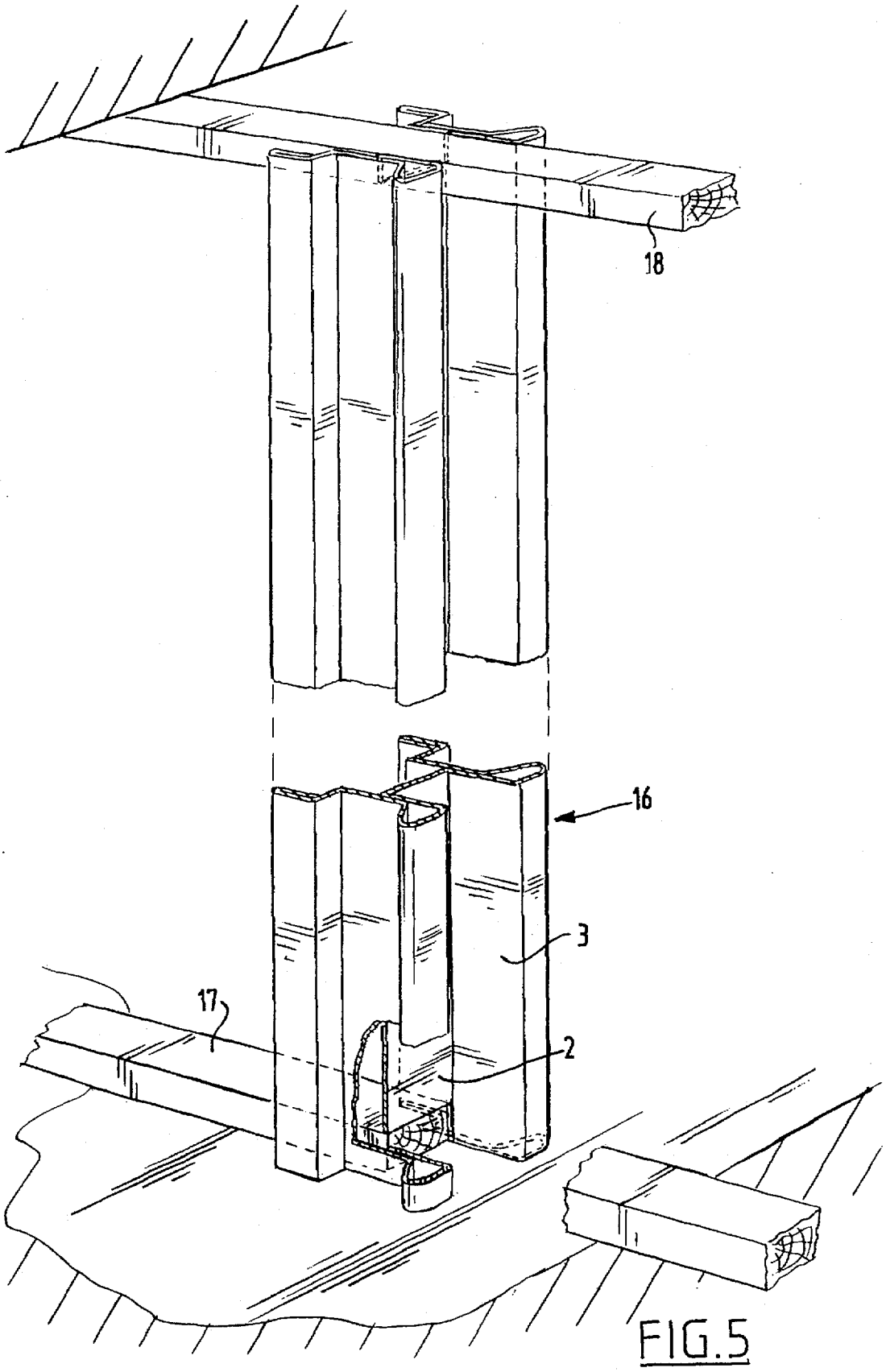
FIG. 5 is a partially broken away perspective view of a profile for use with the wall board according to the present invention.

Shown in FIG. 5 is a profile 16 which differs slightly from the profiles applied in the embodiments according to FIG. 3 and FIG. 4. This illustration likewise shows how the profile can be easily attached to the floor and to the ceiling by arranging on the floor a wooden beam or metal U-profile 17 and arranging on the ceiling an appropriate wooden beam or metal U-profile 18. The shape of the H-shaped profile is such that, after sawing the profile to length at the bottom and top, a small piece of the connecting part 2 of the profile can easily be removed to allow it to fall into place over the relevant beams 17, 18 respectively. Sufficient fixation in sideways direction is brought about by the extending legs 3 of the profile. If necessary, the profile can be additionally fixed to the beams 17 and 18 by horizontally screwing the legs 3 in sideways direction onto the beams 17 and 18. It is likewise possible to bend over the portion of the connecting part 2 for removal and to connect this to the beam, for instance by means of a screw connection.

It will be apparent that for passage of for example water pipes, electricity pipes and the like it is only necessary to arrange holes in the middle part 2 of the profile. When using a metal U-profile this forms a protruding shaft for pulling through cables, pipes and leads. This limits the number of bores to be arranged in the profile, while likewise retaining the greatest possible strength of the profile.

Figure 6:
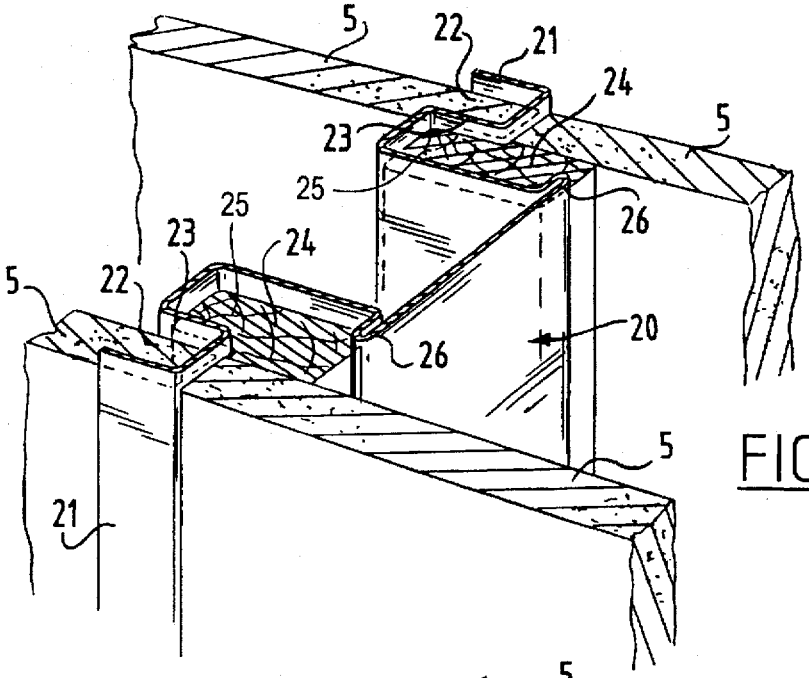
FIG. 6 shows a perspective view of a fifth embodiment of the invention.

In the embodiment shown in FIG. 6 fixation of the wall boards 6 takes place by means of a profile 20, the shape of which differs from the profiles used in the first four embodiments. In this embodiment the profile 20 is provided with an edge 21, whereby a groove 22 is formed in which the edges of the boards 5 can be pushed. The board pushed into the groove 22 is secured respectively by both sides 21, 23 of the groove 22 so that fixation of the boards is obtained.

The boards 5 are provided on one side with strips 24 to which are fastened noses 25. The profile 20 has a shape such that the noses 25 are enclosed on both sides by the profile so that fixation in the transverse direction is obtained, while the profile is provided with a protrusion 26 such that fixation is also obtained in the longitudinal direction. With this embodiment it is also possible to initially push the boards with the nose 25 into the profile and to place the board into its desired, flat end position by turning.

Figure 7:
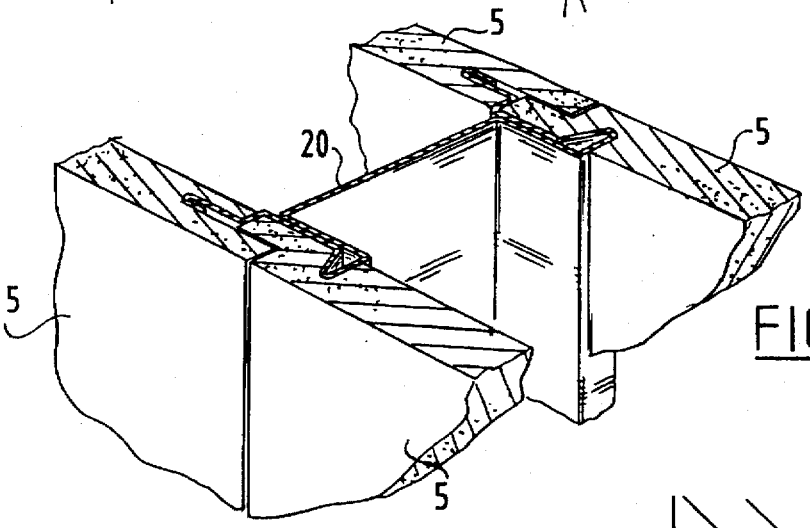
FIG. 7 shows a perspective view of a sixth embodiment of the invention.

Diverse changes can of course be made to this embodiment. For instance, the boards 5 can be provided with a saw-cut on their head end edge opposite the edge to which the frame strip 24 is fixed, and the profile 20 can be provided with a narrower groove 22, so that the edge 21 of the profile becomes invisible because it is assimilated in the groove. It is moreover possible, as shown in FIG. 7, to embody the boards 5 without noses.

Figure 8:
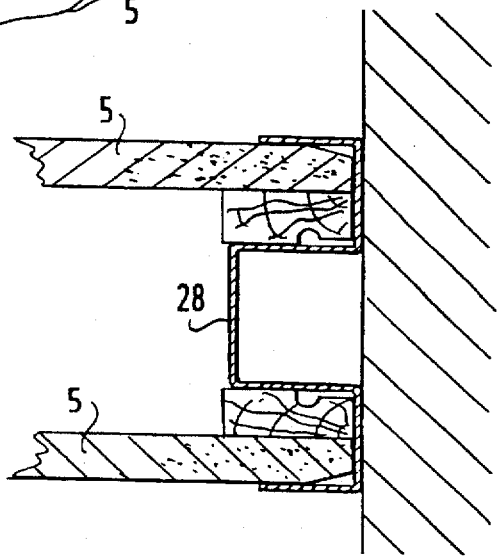
FIG. 8 is a sectional view of an end construction with an end profile.

These embodiments are particularly suitable for applications with wood-like material, for example wall boards made of chipboard. FIG. 8 shows how, using a separate profile 28, the boards 5 can be fixed, without using screws and thus detachably, against a wall.

Figure 9:
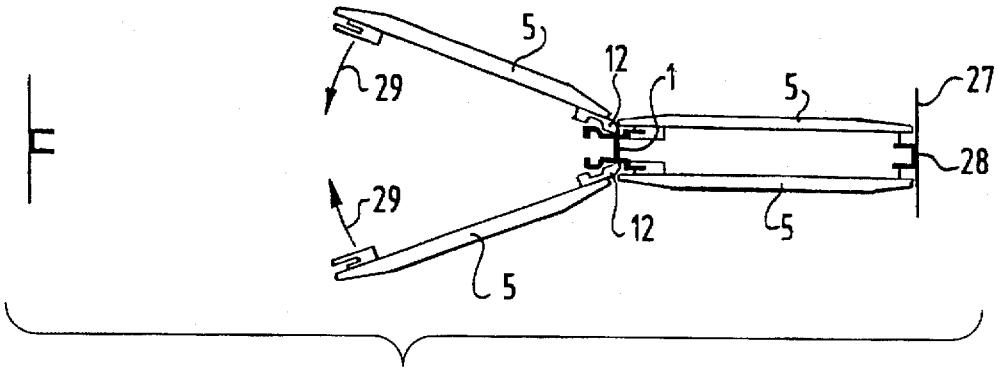
FIG. 9 is a sectional view of the process of double-sided constructing of a wall with wall boards according to the invention.

FIG. 9 shows how a wall is built using the wall boards and profiles according to the invention. Starting from a fixed wall 27, a standard U-profile 28 that is generally used in the building industry is first arranged against this fixed wall. The first two boards 5 are then arranged against the standard profile, wherein fixing against the standard profile 28 takes place either as shown in FIG. 8 or by means of screws. In the groove of the thus positioned boards 5 is then arranged a profile 1 according to the invention so that the first boards 5 are fixed. Afterwards the profile 1 is of course pushed into recesses of the wall boards and optionally fixedly screwed from the side surfaces of the profile to the top and bottom of the wall. The following boards 5 are then arranged wherein these are first arranged with their nose 12 in the space between the profile and the leading edge of the preceding board 5 and the boards 5 are then folded inward as indicated by the arrows 29. The process is then repeated.

With the wall board system according to the invention single-sided construction is also possible, which is shown in FIG. 10. As in double-sided assembly, a single wall board 5 is first arranged against a standard profile 28 as shown in FIG. 10*a*. Thereafter a profile 1 according to the invention is placed as shown in FIG. 10*b*. As according also to FIG. 9 the following wall board 5 is then arranged, as shown in FIG. 10*c*, and the same procedure is continued until one side of the relevant wall is covered. In the thus formed single-sided wall various connections for water, electricity and so on can then be arranged, whereafter, as shown in FIG. 10*e*, the wall can be closed. As shown in FIG. 10*e* the nose of a board 5 is herein pushed over a nose of the frame strip forming part of the preceding board 5.

This method is also applicable in the embodiment according to FIG. 1, although herein a portion of the profile 1 will have to be bent outward each time.

In FIG. 11 an alternative embodiment of a profile is shown. The profile 26 shown in this figure has substantially the same shape as the profile 16 shown in FIG. 5. In the embodiment of FIG. 5 the springs for gripping the grooves arranged in the boards are arranged opposite each other relative to a line extending parallel to the wall, while the gripping elements for gripping the cavities arranged in the boards are likewise arranged mutually opposite. In the alternative embodiment of the profile 30 shown in FIG. 11 the springs 31 are arranged diagonally opposite each other and the protrusions 32 are likewise arranged diagonally opposite each other.

Figure 12:
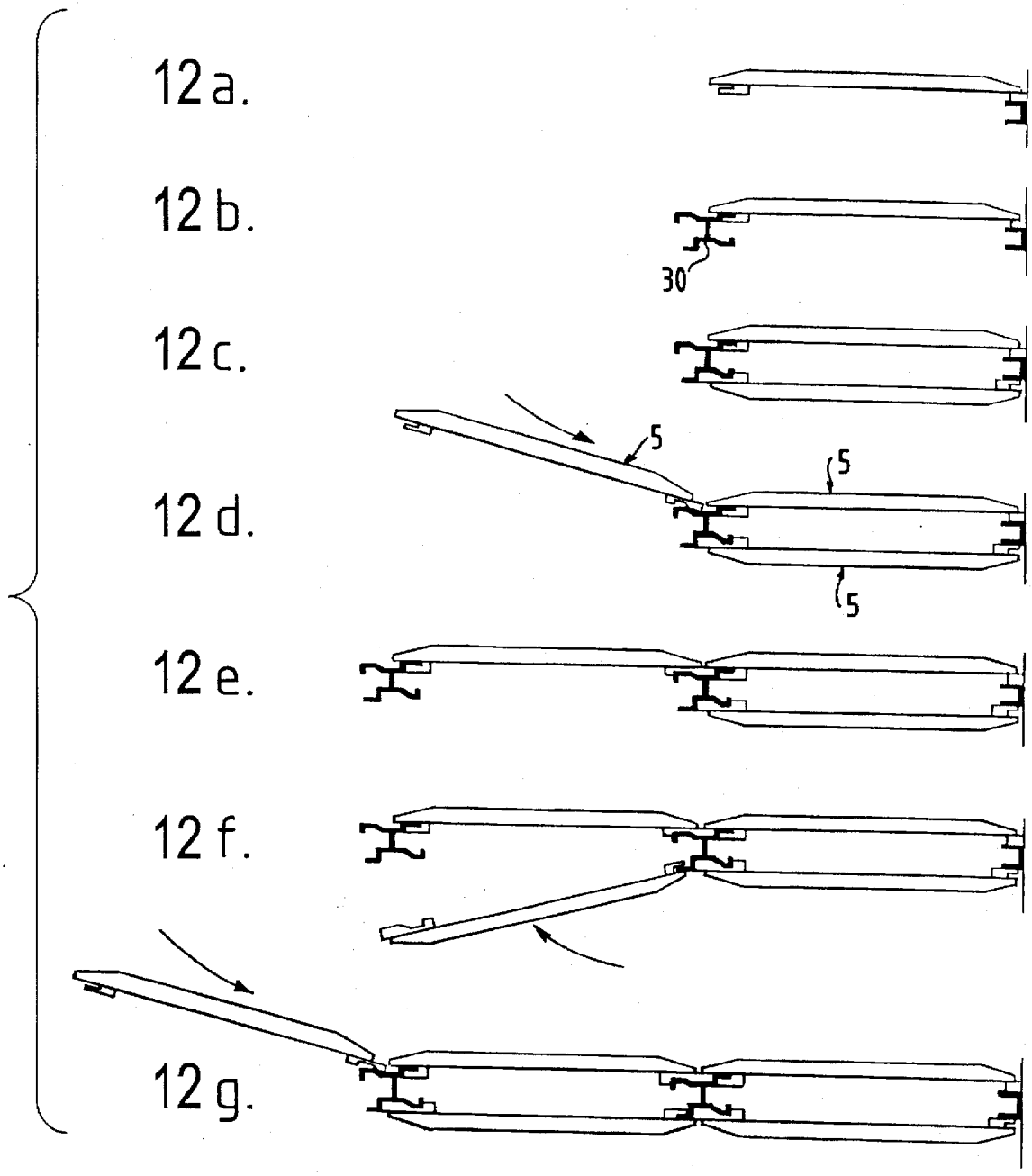

The result of this embodiment is that walls can be built in a different manner, which is shown in FIG. 12. This means that, starting from a situation in which only a U-profile is placed, as shown in FIG. 12*a*, first a wall board is placed, then a profile 30 is placed, whereafter as is shown in FIG. 12*b* a second wall board similar to the first wall board can be arranged, as shown in FIG. 12*c*. This construction method can be continued as shown in FIGS. 12*d*–12*g*.

I claim:

1. System for constructing a wall, the system comprising:

at least a first wall board having a first edge including an inner surface and an outer surface;

at least a second wall board having a second edge including an inner surface and an outer surface;

at least one profile connected with said first edge of said first wall board and with said second edge of said second wall board;

the first wall board comprising at an inner side a first nose in the vicinity of the first edge, so that a groove is formed between the first edge of the first wall board and the first nose;

the second wall board comprising at an inner side a second nose int he vicinity of the second edge, said second nose extending beyond the first edge of the first wall board, the profile comprising a spring fit for insertion in said groove, and comprising a surface extending parallel to an inner surface of the second nose, characterized in that an outer surface of the second nose is flush with the inner surface of the first edge, so that the second nose is fit for locking between the profile and the first edge, and that a recess has been provided perpendicular to and in the inner surface of the second nose and a ridge shaped as the recess has been provided in the profile for gripping said recess.

2. System according to claim 1, characterized in that the first and second noses extend over the full length of the first and second wall boards, respectively.

3. System according to claim 2, characterized in that the noses are fitted to frame strips extending along both edges on the inside of the wall boards.

4. System according to claim 3, characterized in that the frame strips are manufactured from a sounddamping material.

5. A wall board combination for use in a system for constructing a wall including a first wall board, a second wall board and a profile, said wall board combination comprising:

a first wall board having a first edge;

a second wall board having a second edge;

a first nose at an inner side of said first wall board in the vicinity of the first edge, so that a groove is formed between the first edge and the first nose; and a second nose at an inner side of said second wall board in the vicinity of the second edge, an inner surface of said second nose including a second groove, both first and second noses being fitted to frame strips extending along both edges on the inside of each said wall board and extending over the full length thereof, characterized in that the second nose extends beyond the second edge, and that when assembled to form a wall an outer surface of the second nose is flush with an inner surface of the first edge.

6. Wall board combination for use in constructing a wall comprising:

a first wall board having a first edge;

a second wall board having a second edge;

a first nose of a first framing strip being disposed at an inner side of said first wall board in the vicinity of the first edge, so that a first groove is formed between the first edge and the first nose; and a second nose of a second framing strip being disposed at an inner side of said second wall board in the vicinity of the second edge, characterized in that the second nose extends beyond the second edge, and that an outer surface of the second nose is flush with an inner surface of the first edge, and that a second groove is provided perpendicular to and in an inner surface of the second nose.

* * * * *